US007793387B2

(12) United States Patent
Clark

(10) Patent No.: US 7,793,387 B2
(45) Date of Patent: Sep. 14, 2010

(54) DOOR CHECK

(75) Inventor: Stuart Malcolm Clark, Belgrave (AU)

(73) Assignee: M.T.M. Pty Ltd. (AU)

( * ) Notice: Subject to any disclaimer, the term of this patent is extended or adjusted under 35 U.S.C. 154(b) by 672 days.

(21) Appl. No.: 11/661,646

(22) PCT Filed: Aug. 26, 2005

(86) PCT No.: PCT/AU2005/001275

§ 371 (c)(1),
(2), (4) Date: Aug. 16, 2007

(87) PCT Pub. No.: WO2006/007657

PCT Pub. Date: Jul. 27, 2006

(65) Prior Publication Data

US 2008/0066260 A1 Mar. 20, 2008

(30) Foreign Application Priority Data

Aug. 30, 2004 (AU) ..... 2004904943

(51) Int. Cl.
*E05C 17/22* (2006.01)

(52) U.S. Cl. ..... 16/86 C; 16/82; 16/86 B; 292/262

(58) Field of Classification Search ..... 16/82, 16/85, 86 R, 86 A, 86 B, 86 C, 50, DIG. 21; 292/262, 265–267; 296/146.12, 146.11
See application file for complete search history.

(56) References Cited

U.S. PATENT DOCUMENTS 2,232,986 A * 2/1941 Westrope ..... 16/86 C
2,290,331 A * 7/1942 Jacobs ..... 16/86 C
4,833,755 A 5/1989 Bonin
5,152,030 A 10/1992 Cogo
5,474,344 A 12/1995 Lee
6,370,732 B1 4/2002 Yezersky et al.
6,370,733 B2 4/2002 Paton et al.
6,438,794 B2 8/2002 Ng et al.
6,446,305 B1 9/2002 Kneeland
6,467,126 B1 10/2002 Yezersky et al.
6,513,193 B1 2/2003 Yezersky et al.
6,564,424 B1 5/2003 Audisio
6,564,425 B2 5/2003 Audisio (Continued)

FOREIGN PATENT DOCUMENTS

DE 198 15 981 A1 10/1999

*Primary Examiner*—William L. Miller
(74) *Attorney, Agent, or Firm*—Lerner, David, Littenberg, Krumholz & Mentlik, LLP

(57) ABSTRACT

A door check including an arm with an arm mount is provided for mounting the arm to a vehicle door or frame. The arm includes a first surface and an oppositely disposed second surface. The door check further includes an arm guide including a housing, including a guide mount for mounting the housing to the vehicle door or frame, and a guideway for receiving the arm. The arm guide also includes two generally facing arm engaging structures mounted within the housing for receiving the arm therebetween. Each arm engaging structure faces its respective arm surface. The arm guide includes a spring between the housing and the second arm engaging structure. The spring biases that structure towards the first arm engaging structure to urge these structures into contact with the respective arm surfaces restricting longitudinal movement of the arm through the guideway.

15 Claims, 4 Drawing Sheets

U.S. PATENT DOCUMENTS

| | | | | |
|---|---|---|---|---|
| 6,813,811 | B2 * | 11/2004 | Matsuki et al. | 16/86 B |
| 6,901,630 | B2 * | 6/2005 | Liang et al. | 16/82 |
| 7,076,833 | B2 * | 7/2006 | Murayama et al. | 16/82 |
| 7,143,473 | B2 * | 12/2006 | Matsuki | 16/86 C |
| 7,240,399 | B2 * | 7/2007 | Murayama et al. | 16/82 |
| 7,383,614 | B2 * | 6/2008 | Matsuki | 16/86 B |
| 7,469,944 | B2 * | 12/2008 | Kitayama et al. | 292/262 |
| 7,530,141 | B2 * | 5/2009 | Heinrichs et al. | 16/86 C |
| 2001/0016965 | A1 | 8/2001 | Paton et al. | |
| 2002/0112317 | A1 | 8/2002 | Hayashi | |
| 2002/0148074 | A1 | 10/2002 | Audisio | |
| 2003/0016895 | A1 | 1/2003 | Holm et al. | |
| 2003/0037411 | A1 | 2/2003 | Seo | |
| 2003/0051312 | A1 | 3/2003 | Hoffmann et al. | |
| 2003/0111862 | A1 | 6/2003 | Audisio | |
| 2003/0145524 | A1 | 8/2003 | Ihashi | |
| 2003/0159244 | A1 | 8/2003 | Sparkman | |
| 2004/0049882 | A1 | 3/2004 | Schmoll et al. | |
| 2004/0111832 | A1 | 6/2004 | Murayama et al. | |

* cited by examiner

DOOR CHECK

FIELD OF THE INVENTION

The present invention relates generally to a door check. More particularly, the present invention relates to a door check for installation between the body of a motor vehicle and the door of a motor vehicle and will herein be generally described in this context. However, it is to be appreciated that the invention has broader application and is not limited to that particular use.

BACKGROUND OF THE INVENTION

Door checks are used in the automotive industry for checking the swinging motion of vehicle doors. Typically, door checks provide one or more pre-defined open door positions, including at least one partially opened position and a fully opened position.

Generally speaking, the manufacturing costs of existing door checks are undesirably high. This is, at least in part, due to their relatively complicated designs.

Further, existing door checks are prone to excessive operational noise. Excessive operational noise is often exacerbated by the door check accumulating dust and dirt.

OBJECTS OF THE INVENTION

It is an object of the invention to provide a door check of simplified construction when compared to existing door checks.

It is another object of the invention to provide a door check that is more economical to manufacture.

It is a further object of the invention to provide a door check that is less prone to excessive operational noise.

SUMMARY OF THE INVENTION

According to a broad aspect, the present invention relates to a door check. The door check comprises an arm, the arm including an arm mount provided at one end thereof for mounting the arm to one of a vehicle door or vehicle frame. The arm also comprises a generally longitudinally extending first surface and an oppositely disposed longitudinally extending second surface. The door check further comprises an arm guide. The arm guide includes a housing, the housing comprising a guide mount for mounting the housing to the other of the vehicle door or vehicle frame, and a guideway for receiving the arm therein. The arm guide also comprises first and second generally facing arm engaging structures mounted to or within the housing for receiving the arm therebetween. The first arm engaging structure is mounted to the housing and faces the first arm surface. The second arm engaging structure faces the second arm surface. The arm guide further comprises biasing means mounted between an inner surface of the housing and the second arm engaging structure. The biasing means is configured to bias the second arm engaging structure towards the first arm engaging structure, to urge the arm engaging structures into contact with the respective arm surfaces and thereby restrict longitudinal movement of the arm through the guideway, the first arm engaging structure comprises a pair of slider pads, with each of the pair of slider pads mounted to an opposing housing sidewall adjacent the guideway opening. Each of the pair of slider pads comprises an arm contact surface facing and in contact with the first arm surface. A second arm engaging structure is also provided, comprising a slider pad having an arm contact surface facing and in contact with the second arm surface.

Preferably, the housing includes an opening. The opening may be provided at one end of the housing. The provision of an opening provides an access point into the housing for installing at least some of the arm guide components when assembling the door check.

It is envisaged that when the arm guide is fully assembled, the housing opening remains uncovered. This obviates the need for an additional component in the form of a closure for the housing opening.

The arm mount may be configured for mounting to either of a vehicle door or a vehicle frame. Likewise, the guide mount may be configured for mounting to the other of a vehicle door and a vehicle frame. In a preferred arrangement, however, the arm mount is configured for mounting to an inner surface of a vehicle door pillar and the guide mount is configured for mounting to an inner surface of a vehicle door structure In a preferred form, the arm mount is pivotally connected to the arm, while the guide mount is rigidly connected to the guide.

In a preferred form, the second arm surface includes at least one position locator for locating the second arm engaging structure at a specific location longitudinally along the arm. More preferably, the second arm surface includes at least two position locators spaced longitudinally along the arm for enabling the location of the second arm engaging structure at any one of at least two discrete positions longitudinally along the arm. Still more preferably, the second arm engaging structure is locatable at three discrete positions along the arm, with one of these positions corresponding to the vehicle door being closed.

The at least one position locator may adopt any suitable form. Each locator may correspond to a depression or detent in the second arm surface for receiving the second arm engaging structure. Alternatively, each locator may be defined between two proximate raised portions longitudinally spaced along the second arm surface.

It is envisaged that the first arm surface need not include position locators thereon.

In an alternative arrangement, the friction forces existing between the arm engaging structures and the arm surfaces may be such as to enable the arm engaging structures to locate at least two desired positions longitudinally along the arm, these positions including the door being closed and fully open. In this way, the requirement for including at least one position locator on the second arm surface may be obviated.

Thus, it is to be appreciated the arm engaging structures may adopt any suitable form. The arm engaging structures may be similarly configured. Possible arm engaging structures include, but are not limited to, friction blocks, friction pads, rollers and ball bearings.

The arm may include an end stop for limiting longitudinal movement of the arm through the guideway.

The biasing means may adopt any suitable form, including a compression spring or other resilient member, such as a rubber block.

The biasing means may be pre-stressed.

Further, the biasing means and the second arm engaging structure may be integrated.

According to another broad aspect of the invention, there is provided a door check, comprising:

an arm, the arm comprising:

an arm mount provided at one end thereof for mounting the arm to one of a vehicle door or vehicle frame; and a generally longitudinally extending first surface and an oppositely disposed longitudinally extending second surface;

an arm guide, the arm guide comprising:

a housing, the housing comprising:

a guide mount for mounting the housing to the other of the vehicle door or vehicle frame;

a guideway for receiving the arm therein; and an open end first and second generally facing arm engaging structures for receiving the arm therebetween;

the first arm engaging structure comprising at least one slider pad mounted to the housing adjacent the guideway opening and comprising an arm contact surface facing and in contact with the first surface of the arm; and the second arm engaging structure comprising a slider pad slidably mounted within the housing and facing the second arm surface, the slider pad having an arm contact surface facing and in contact with the second arm surface;

biasing means mounted between an inner surface of the housing and the second arm engaging structure; the biasing means being configured to bias the second arm engaging structure towards the first arm engaging structure, to urge the arm engaging structures into contact with the respective arm surfaces and thereby restrict longitudinal movement of the arm through the guideway.

It will be convenient to hereinafter describe preferred embodiments of the invention with reference to the accompanying drawings. The particularity of the drawings and the associated description is to be understood as not limiting the preceding broad description of the invention.

DETAILED DESCRIPTION

Figure 1:
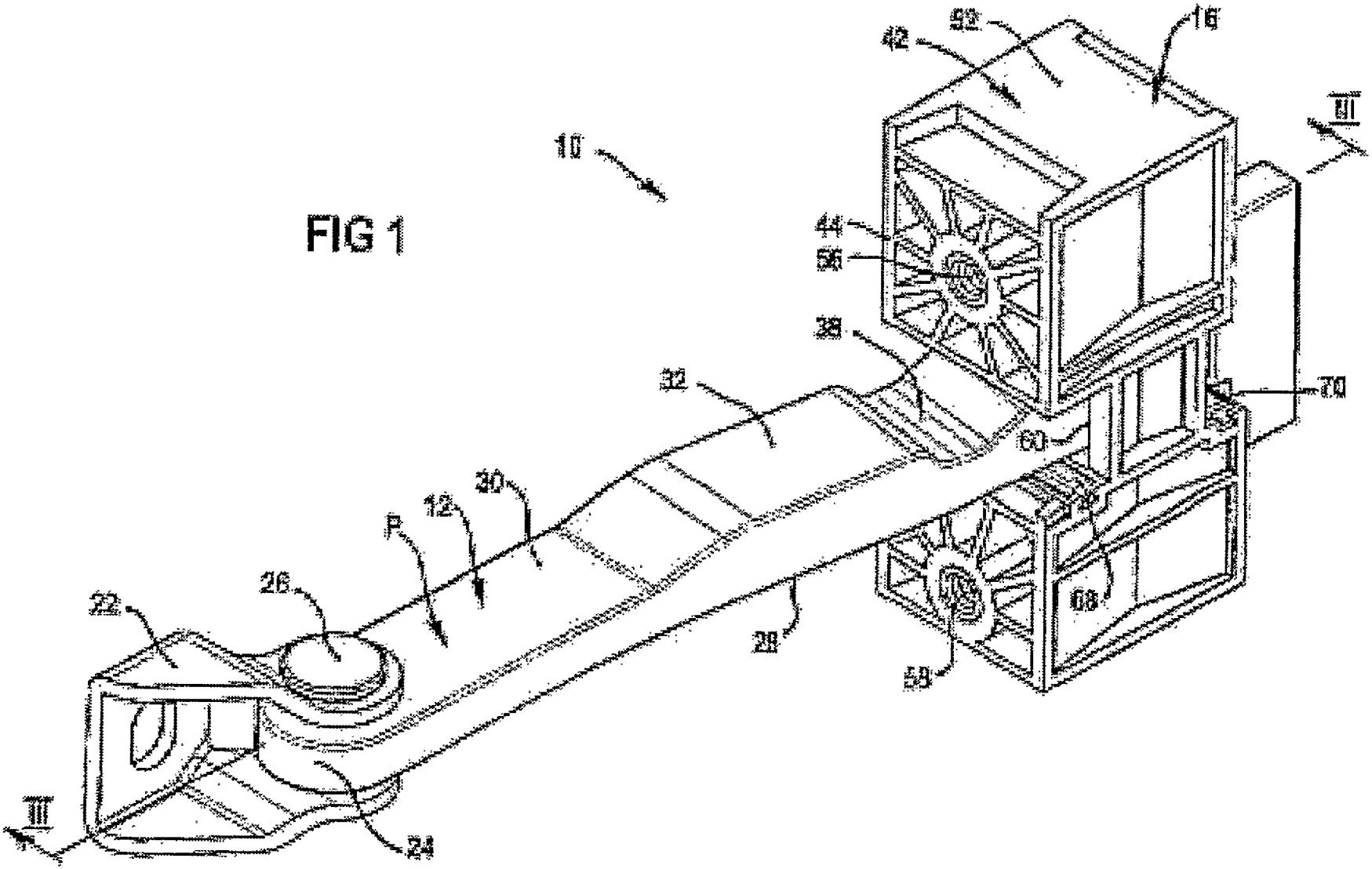
FIG. 1 is a perspective view of a door check according to one embodiment of the present invention.
Figure 2:
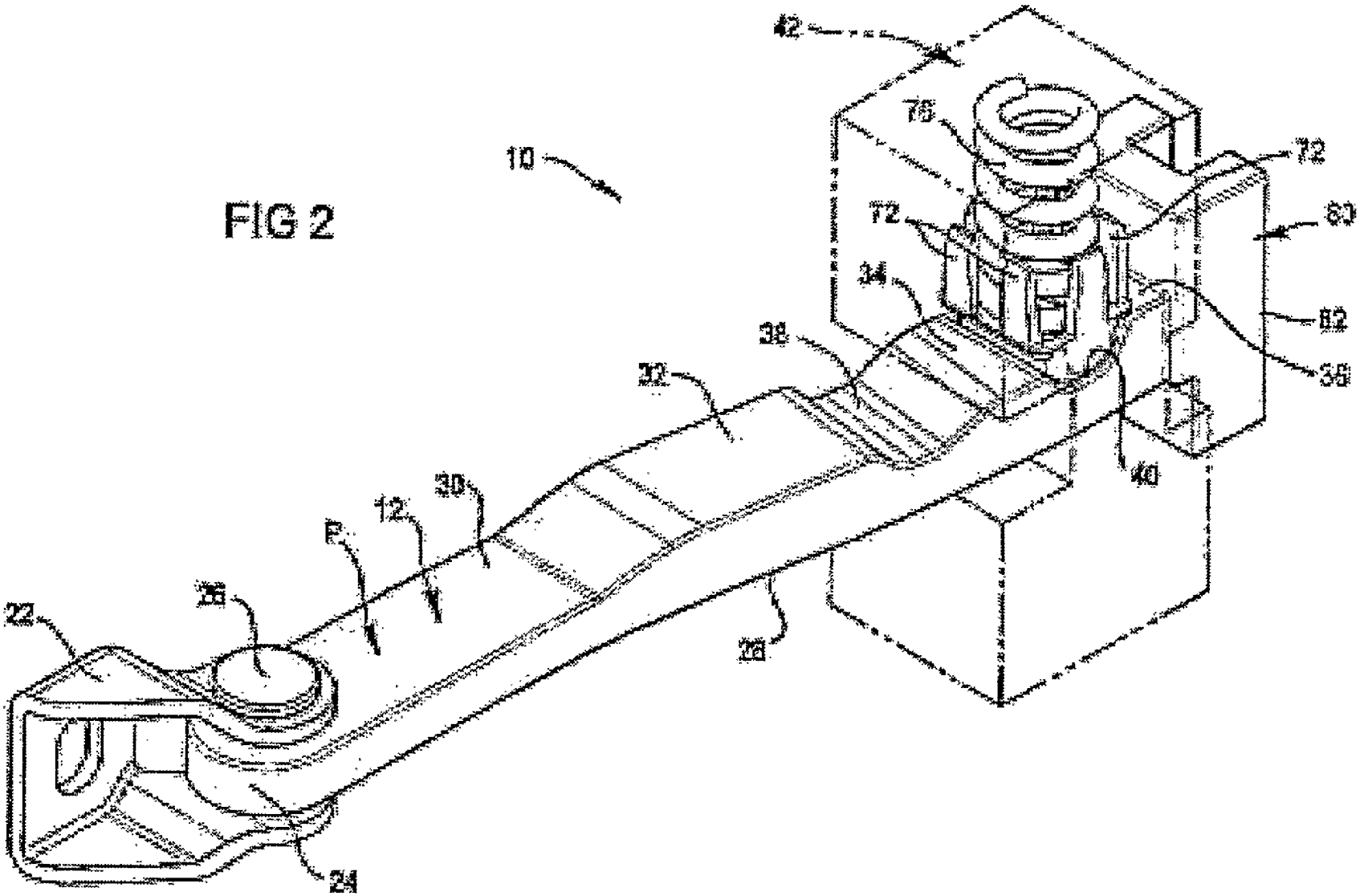
FIG. 2 is a perspective view of the door check of FIG. 1 with a portion illustrated in phantom lines.
Figure 3:
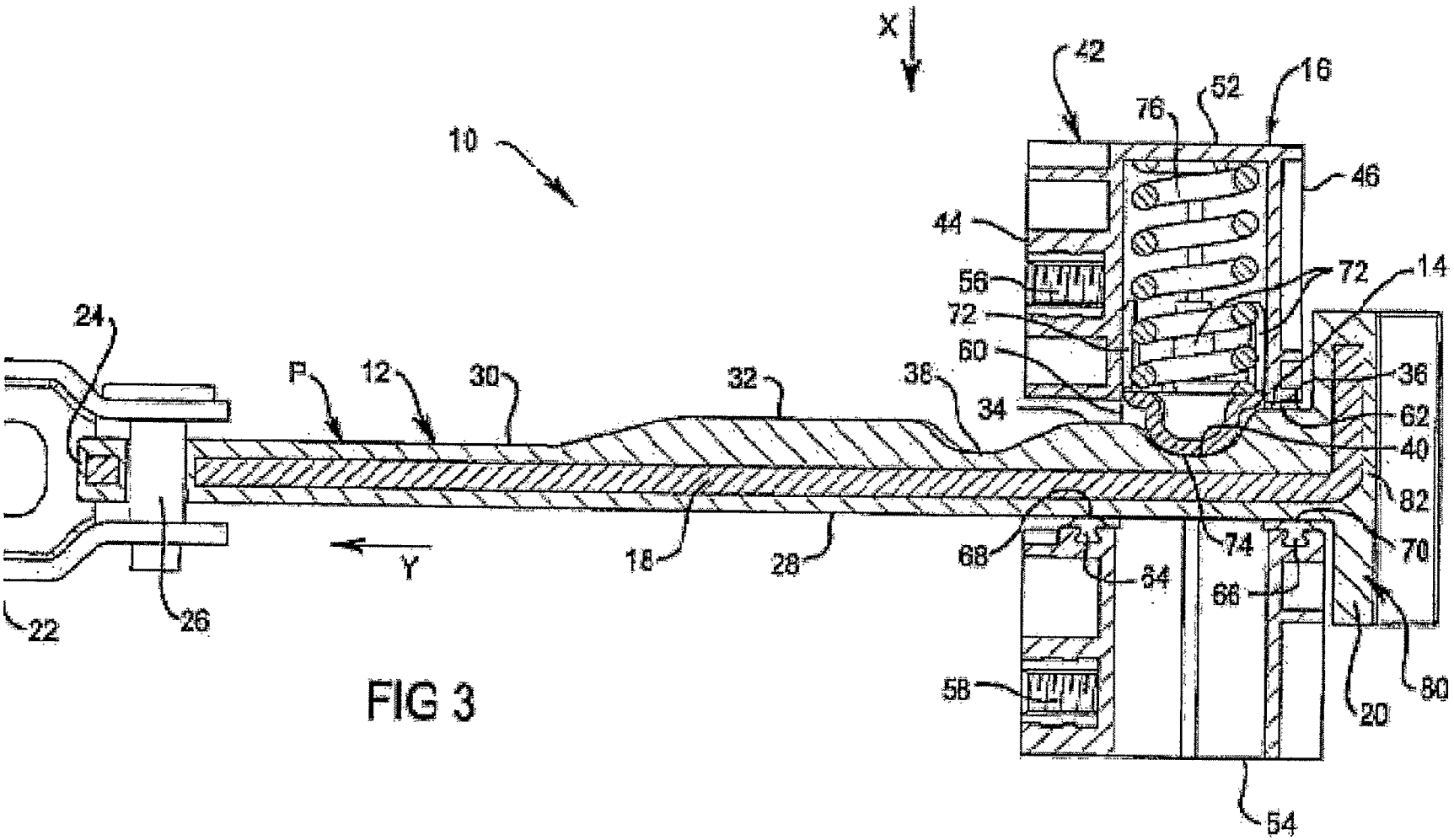
FIG. 3 is a sectional side view of the door check illustrated in FIG. 1.

FIGS. 1, 2 and 3 illustrate a door check 10. The door check 10 includes an arm 12, which is receivable in a guideway 14 of an arm guide 16.

The arm 12 may be manufactured from any suitable material(s) and, in the illustrated embodiment includes a steel core 18 having a low-friction, high-density plastic coating 20.

The arm 12 includes a mount in the form of a bracket 22 at one longitudinal end 24 thereof. The bracket 22 is pivotally connected to the arm 12 by a pivot pin (or stud) 26. The bracket 22 is provided for securely mounting the arm 12 to an inner surface of a vehicle door pillar (not illustrated).

The arm 12 includes a generally longitudinally extending first surface 28 and an oppositely disposed longitudinally extending second surface 30. The first surface 28 is generally flat, while the second surface 30 includes three raised portions 32,34,36. The raised portions 32,34,36 define two locators in the form of detents 38,40.

The arm guide 16 includes a housing 42, which may be manufactured from any suitable material, including high-density plastic, steel and a combination thereof. The housing 42 includes sidewalls 44,46, a front wall (not clearly illustrated), a rear wall (not clearly illustrated) and an endwall 52. The housing 42 also includes an open end 54.

The sidewall 44 includes a guide mount in the form of two internally threaded apertures 56,58. The threaded apertures 56,58 are provided for rigidly mounting the arm guide 16 to the inner surface of a vehicle door (not illustrated).

The guideway 14 extends through the housing 42 between the sidewalls 44,46. Respective guideway openings 60,62 are provided in the sidewalls 44,46 for receiving the arm 12.

The arm guide 16 includes a first arm engaging structure in the form of a pair of slider pads 64,66. The pad 64 is moulded into the sidewall 44 adjacent the opening 60, and the pad 66 is moulded into the sidewall 46 adjacent the opening 62. The pads 64,66 include respective arm contact surfaces 68,70 which face (and indeed contact with) the first surface 28 of the arm 12. The pads 64,66 may be manufactured from any suitable material, including high-density plastic or rubber. The pads 64,66 may be replaced by a single pad arrangement, if desired.

A second arm engaging structure is provided in the form of a slider 72. The slider 72 includes an arm contact surface 74 for facing and contacting the second arm surface 30. The slider 72 may be manufactured from any suitable material, including high-density, low-friction plastic.

The arm guide 16 includes a biasing means in the form a coil spring 76. The coil spring 76 is mounted in the housing 42 between the endwall 52 and the slider 72. The slider 72 may include an integrally formed, centrally disposed spring locator for locating the spring 76 thereon, however this feature is not illustrated.

The spring 76 and the slider 72 are fitted within the housing 42 by insertion through the open end 54. It is to be appreciated that the open end 54 is not sealed prior to installation and use of the door check 10, thereby obviating the need for an extra door check component in the form of a cover or closure for the open end 54.

The spring 76 is provided for biasing the slider 72 in the direction X towards the plane defined by the contact surfaces 68,70. This, in turn, urges the contact surface 74 of the slider 72 into contact with the detent 38 to retain the vehicle door (not illustrated) in a first pre-defined open position. The detent 40 is provided for receiving the contact surface 74 of the slider 72, so as to retain the vehicle door in a second pre-defined position, by sliding the arm 12 in the direction Y.

The vehicle door is closed when the contact surface 74 of the slider 72 is in the position on the arm 12 indicated generally by P.

The stiffness of the spring 76 is selected such that the door check 10 retains the door at the desired open position (with the slider 72 located in either of the detents 38,40) while still enabling the open position of the door to be altered by an individual when required. The necessary stiffness of the spring 76 is dependent upon several factors, including the coefficient of friction between the slider 72 and the arm 12, as well as the coefficient of friction between the slider pads 64,66 and the arm 12.

The arm end 80 includes an integrally formed end stop 82 for limiting the extent of longitudinal movement of the arm 12 through the guideway 14.

Figure 4:
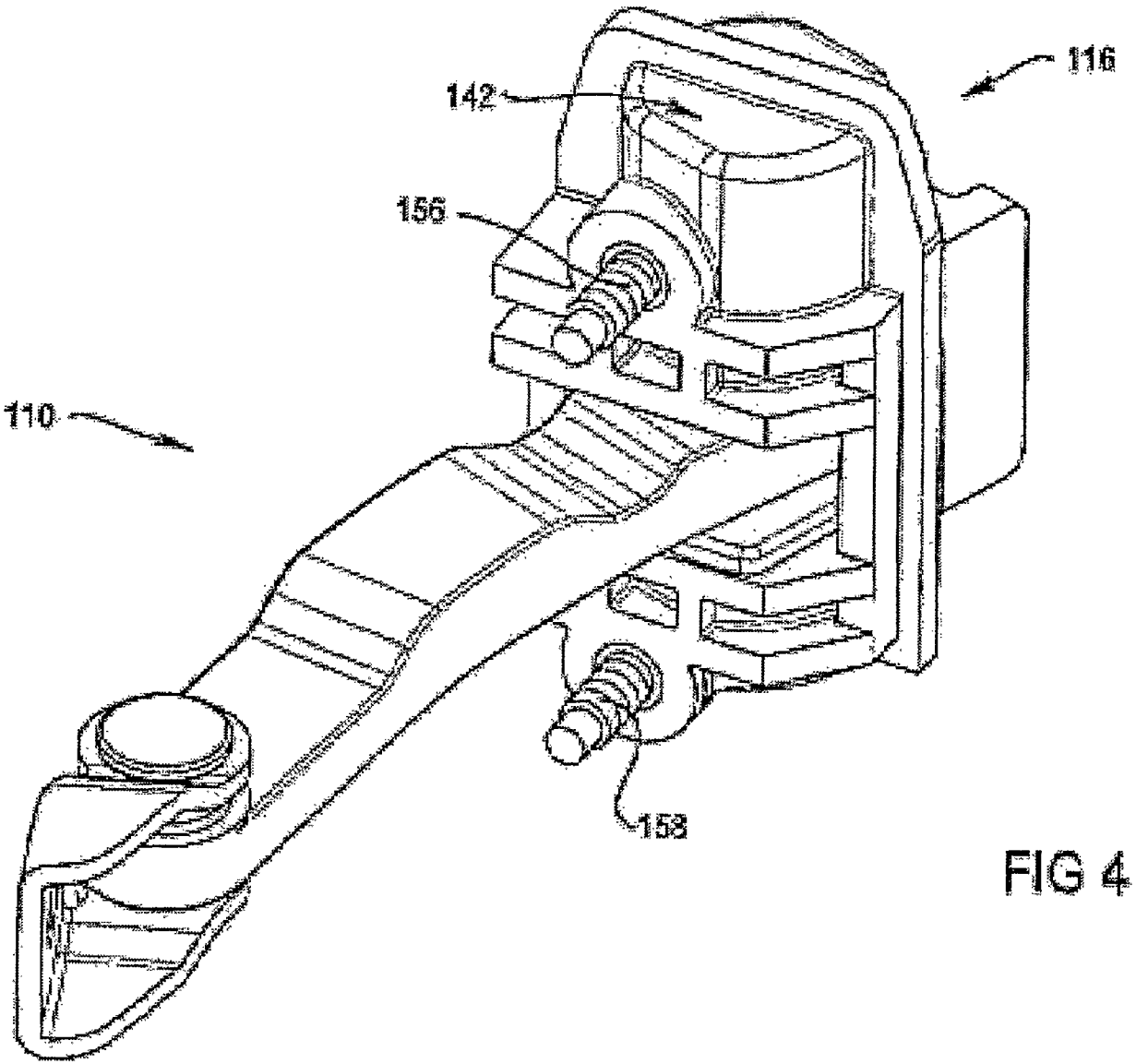
FIG. 4 is a perspective view of a door check according to another embodiment of the present invention.

The door check 110 illustrated in FIG. 4 is similar in many respects to the door check 10 illustrated in FIGS. 1 to 3. One notable difference is that the door check 110 includes rigidly mounted threaded studs 156,158 for rigidly mounting the arm guide 116 to the inner surface of a vehicle door (not illustrated), in place of the internally threaded apertures 56,58 of the door check 10 illustrated in FIG. 1.

Further, the housing 142 of the door check 110 is of a slightly different shape to the housing 42 of the door check 10.

Also, while not illustrated in FIG. 4, the two slider pads 64,66 of the door check 10 illustrated in FIGS. 1 to 3 have been replaced by a single pad.

Advantageously, the present invention provides a simplified door check when compared to existing door checks. One reason for this resides in the fact that existing door checks generally include two opposed biasing means within the housing. The present invention requires only one biasing means in the form of spring 76. Further, existing door checks generally include separate sliders, whereas, advantageously, the present invention includes only one slider. Thus the door check of the present invention is potentially cheaper to manufacture and requires less assembly time.

Other benefits of the new door check will be readily apparent to persons skilled in the art.

Finally, it is to be understood that various alterations, modifications and/or additions may be introduced into the construction and arrangement of the parts previously described without departing from the spirit or ambit of this invention.

The claims defining the invention are as follows:

1. A door check, comprising;

an arm, the arm comprising:

an arm mount provided at one end thereof for mounting the arm to one of a vehicle door or vehicle frame; and a generally longitudinally extending first surface and an oppositely disposed longitudinally extending second surface;

an arm guide, the arm guide comprising:

a housing, the housing comprising:

a guide mount for mounting the housing to the other of the vehicle door or vehicle frame;

a guideway for receiving the arm therein; and first and second generally facing arm engaging structures for receiving the arm there between;

the first arm engaging structure being mounted to the housing and facing the first arm surface; and the second arm engaging structure slidably mounted within the housing and facing the second arm surface;

biasing means mounted between an inner surface of the housing and the second arm engaging structure; the biasing means being configured to bias the second arm engaging structure towards the first arm engaging structure, to urge the arm engaging structures into contact with the respective arm surfaces and thereby restrict longitudinal movement of the arm through the guideway; wherein the first arm engaging structure comprises a pair of slider pads, with each slider pad mounted to an opposing housing sidewall adjacent the guideway opening; and each of the pair of slider pads comprising an arm contact surface facing and in contact with the first arm surface; and the second arm engaging structure comprising a slider pad having an arm contact surface facing and in contact with the second arm surface.

2. A door check according to claim 1, wherein the housing comprises an open end.

3. A door check according to claim 1, wherein the vehicle frame includes at least one door pillar, and the arm mount is configured for mounting to an inner surface of the at least one door pillar of the vehicle frame and the guide mount is configured for mounting to an inner surface of the vehicle door.

4. A door check according to claim 1, wherein the arm mount is pivotally connected to the arm, and the guide mount is rigidly connected to the arm guide.

5. A door check according to claim 1, wherein the second arm surface comprises at least one position locator for locating the second arm engaging structure at a discrete position longitudinally along the arm.

6. A door check according to claim 5, wherein the second arm surface comprises at least two position locators spaced longitudinally along the arm for locating the second arm engaging structure at any one of at least two discrete positions longitudinally along the arm.

7. A door check according to claim 6, wherein the second arm engaging structure is locatable at three discrete positions longitudinally along the arm, with one of these positions corresponding to the vehicle door being closed.

8. A door check according to claim 5, wherein each position locator corresponds to a depression or detent in the second arm surface for receiving the second arm engaging structure.

9. A door check according to claim 5, wherein each position locator is defined between two proximate raised portions longitudinally spaced along the second arm surface.

10. A door check according to claim 5, wherein each position locator is at least partially defined by a friction force existing between second arm surface and the second arm engaging structure.

11. A door check according to claim 1, wherein the arm comprises an end stop for limiting longitudinal movement of the arm through the guideway.

12. A door check according to claim 1, wherein the biasing means comprises at least one of a compression spring and a rubber block.

13. A door check according to claim 1, wherein the biasing means is pre-stressed.

14. A door check according to claim 1, wherein the biasing means and the second arm engaging structure are integrated.

15. A door check according to claim 1, wherein the first surface of the arm is generally flat, and the second surface of the arm comprises three longitudinally spaced raised portions defining two locators in the form of detents between the spaced raised portions.

* * * * *